United States Patent [19]

Leuenberger

[11] Patent Number: 4,630,936

[45] Date of Patent: Dec. 23, 1986

[54] ELECTRONIC TIMEPIECE

[75] Inventor: Claude-Eric Leuenberger, Chezard, Switzerland

[73] Assignee: Asulab S.A., Bienne, Switzerland

[21] Appl. No.: 850,784

[22] Filed: Apr. 11, 1986

[30] Foreign Application Priority Data

Apr. 12, 1985 [CH] Switzerland ..... 01571/85

[51] Int. Cl.[4] ..... G04B 9/00

[52] U.S. Cl. ..... 368/66

[58] Field of Search ..... 368/66, 76, 80; 318/696

[56] References Cited

U.S. PATENT DOCUMENTS 4,216,648 8/1980 Maire ..... 368/66

4,312,058 1/1982 Shida et al. ..... 368/66

*Primary Examiner*—Vit W. Miska

*Attorney, Agent, or Firm*—Griffin, Branigan, & Butler

[57] ABSTRACT

The timepiece comprises an oscillator (1), a frequency divider (2), a control circuit (3), a stepping motor (4), a seconds hand (5), a circuit (7) for detecting steps missed by the motor, an up-down counter (15) having a capacity N, and a flip-flop (16). At each missed step the detecting circuit (7) generates a tally pulse ($S_7$) which increments the counter (15). The latter is also decremented by periodic pulses appearing on the B output of the frequency divider (2).

When a cell supplying the timepiece is nearly exhausted, the number of steps missed per unit of time is high and the counter (15) is, on balance, incremented. When passing from state N−1 to state N the counter issues on its $Q_h$ output a pulse that causes the Q output of the flip-flop (16) to go high. The control circuit (3) produces, in response to this high state of the flip-flop, a signal warning of the imminent end of the cell's life in the form of an irregular motion of the seconds hand (5).

Otherwise, when the cell is still good, the number of missed steps is low and the counter (15) is decremented. When passing from state 1 to state 0 the counter issues on its $Q_b$ output a pulse that causes the Q output of the flip-flop (16) to go low, thereby stopping the warning signal.

5 Claims, 2 Drawing Figures

ELECTRONIC TIMEPIECE

BACKGROUND OF THE INVENTION

This invention relates to an electronic timepiece of the kind comprising means for producing drive pulses, a motor having a rotor and means for turning the rotor through a set angle in response to each drive pulse, an autonomous source for supplying the drive pulse producing means with electric energy, means for producing a signal upon detecting the imminent end of the source's life and means for producing a warning signal in response to the signal from the detecting means.

Electronic timepieces, in particular watches and alarm and other small clocks of the analogue kind, are well known and work most reliably as long as the energy in the source is sufficient.

The electric energy sources of such small volume timepieces are essentially cells. As the available energy of the cell diminishes some of its parameters change, in particular the voltage across the cell's terminals drops. In high energy density cells, such as mercury, silver or lithium cells used in timepieces, the voltage drops very rapidly when the cell nears exhaustion. Now, it is essential for the cell's voltage to be sufficiently high if the timepiece and in particular its motor are to work properly. When the voltage drops below a critical threshold, the timepiece starts showing signs of failure and, a few days later, it stops altogether. The first signs of failure are erratic dwells of the motor's rotor in response to drive pulses, whereas other elements of the timepiece, such as the electronic circuits, that are less sensitive to a voltage drop, carry on working normally until the motor comes to a full stop.

Uncertainty about the imminent end of a cell's life is a major drawback that has considerably slowed down sales of early electronic timepieces.

To overcome this drawback it has been proposed to incorporate in electronic timepieces means for detecting the end of a cell's life. These detector means, in known arrangements, consist of an electronic circuit that accurately measures the cell's voltage and of an electronic circuit that produces a warning signal when the voltage reaches the critical threshold, to make the user aware of the imminent stoppage of the motor.

A voltage measurement circuit suitable for use in a watch is for instance described and illustrated in U.S. Pat. No. 4,024,415 wherein terminal X of FIGS. 8 and 9 changes its logic state when the cell's voltage, $V_{DD}$, drops below the critical threshold.

This information is used to produce the warning signal. The latter may, for instance, take the form of a periodic modification of the rhythm at which the seconds hand moves forward, causing the needle's motion to become irregular without however affecting the right time or increasing the motor's energy consumption. Such a periodic change may be achieved with a circuit such as described in Swiss Patent Specification No. 607 603.

Since the electronic circuits can still safely operate when the cell's voltage is no longer sufficient to drive the motor, this kind of detecting means would be satisfactory if the voltage measurement circuit did not involve major production difficulties as is the case.

The voltage in the vicinity of the critical threshold needs to be measured most accurately, to within a few tens of millivolts. This accuracy must be influenced neither by temperature nor by the ageing of the elements. Now, such standards are very difficult to achieve even with circuits specially designed for the purpose and often requiring external components having to be individually adjusted, thereby complicating manufacture and increasing costs.

Further, such detecting means will only work properly with the type of cell it has been designed for, e.g. a mercury cell, and if the cell is replaced with a silver cell having a different critical threshold, the detecting means will provide an erroneous indication. Nowadays, however, it has become the practice to produce timepieces able to work equally well with mercury, silver or lithium cells. No known means for detecting the end of a cell's life can therefore be used in this type of timepiece.

SUMMARY OF THE INVENTION

An object of the invention is to overcome or reduce these drawbacks by providing a timepiece fitted with highly reliable means for detecting the end of a cell's life and suited to various types of cell.

According to the invention there is provided a timepiece of the kind set forth wherein the detecting means include means for producing a tally signal whenever the rotor does not turn correctly in response to a drive pulse and a counter arranged to be incremented by said tally signal, with said counter producing, in response to a predetermined state, the imminent end-of-life signal.

BRIEF DESCRIPTION OF THE DRAWINGS

In the accompanying drawings, given by way of example and in which the same references have been used to designate similar parts.

DETAILED DESCRIPTION

Figure 1:
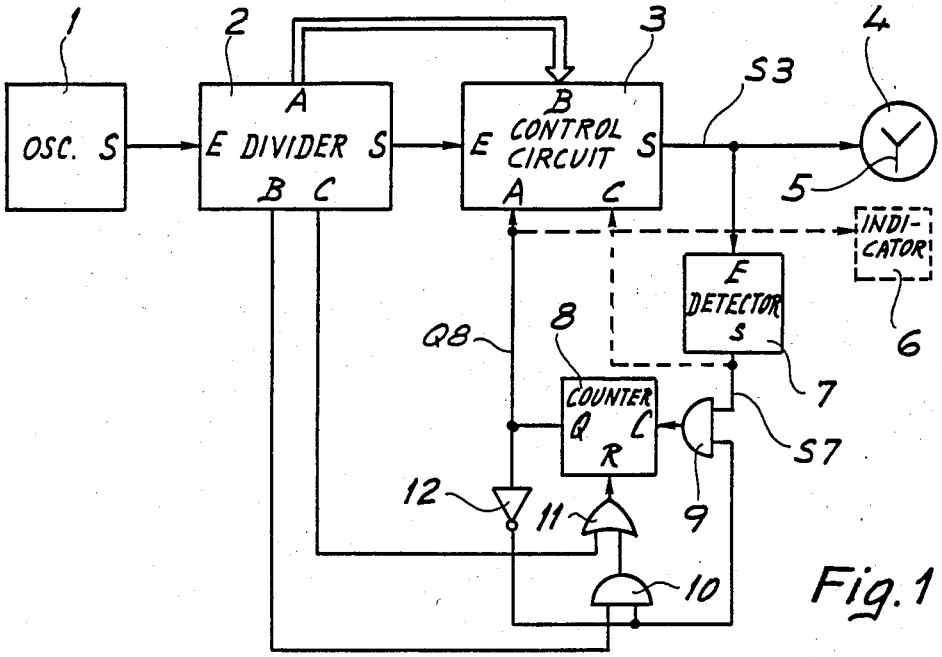
FIG. 1 is a diagram of a first form of embodiment of a circuit for a timepiece according to the invention.

The FIG. 1 circuit comprises an oscillator 1, e.g. a quartz oscillator, a frequency divider 2, a control circuit 3, a stepping motor 4 having a rotor that drives, via a gear-train not shown, time display hands and in particular a seconds hand 5, a circuit 7 for detecting steps missed by motor 4 and issuing a signal whenever motor 4 has not rotated in response to a drive pulse from the control circuit, a counter 8, a pair of two-input AND gates 9 and 10, a two-input OR gate 11 and an inverter 12. A cell not shown supplies energy to the various circuits and to the motor 4.

The output S of oscillator 1 issues a reference signal which is applied to the input E of frequency divider 2. The latter issues on its main output S a time signal of e.g. 1 Hz which is applied to the input E of control circuit 3. Divider 2 further issues logic signals of various frequencies on a multiple output A, a one pulse per minute signal on an output B and a one pulse per hour signal on an output C. All of these signals are derived in known manner from the oscillator signal and the frequencies of the latter two signals may of course differ from those indicated.

Control circuit 3 has a multiple input B that receives the signals issued by the output A of frequency divider 2, and produces in known manner, with the aid of combinative logic circuits and from these signals and the time signal applied to its output E, a control signal $S_3$ that is issued on its output S. Signal $S_3$ consists of a succession of drive pulses at one second intervals from each other. This signal is applied to stepping motor 4 and, in response to each drive pulse, the rotor turns through a set angle to move seconds hands 5 forward by one second.

Circuit 3 further has an input A whose logic state influences the position of the drive pulses in relation to each other, without however changing their number, and hence modifies the motion of motor 4. When input A is low, the pulses, which may be split up into even and odd pulses, are evenly distributed in time and motor 4 thus moves forward one step after each second thereby driving seconds hands 5 at the same rhythm. But when input A is high, the even pulses are shifted in relation to the odd pulses such that, for instance, an even pulse will immediately be followed by an odd pulse. The motor then moves forward by two closely spaced steps every two seconds. Seconds hand 5 then progresses irregularly, giving a halting impression, while still showing the right time. This halting motion, which is clearly noticeable, constitutes the warning signal, telling the user that the timepiece is about to stop. A form of circuit enabling the seconds hand of a timepiece to move forward irregularly is shown in FIG. 1 of Swiss Patent Specification No. 607 603 cited earlier. The references P and S that are visible in that figure respectively correspond to the input A of control circuit 3 and to the motor 4 of FIGS. 1 and 2 of the present case. The circuit 3 may further have an input C whose purpose will be explained later.

Control signal $S_3$ is also applied to the input E of detecting circuit 7. Circuit 7 issues on its output S a tally signal $S_7$ indicating the non rotation of the rotor of motor 4 in response to a drive pulse of signal $S_3$; the faulty operation of the motor may be attributed to a variety of causes, in particular the exhaustion of the cell supplying the time piece.

Various forms of missed step detecting circuit are known, e.g. that shown diagrammatically in FIG. 12 of Swiss Patent Specification No. 628 201. In this circuit the signal that is applied to the motor includes, between two drive pulses, a short test pulse of insufficient duration to cause the rotor to turn. This test pulse creates in the motor a current which flows through a measurement resistance 117 and produces at its terminals a voltage which is compared with a reference voltage by means of a differential amplifier 110 that issues on its output a logic signal H. Signal H corresponds to tally signal $S_7$ in the circuits of the present case. This logic signal stays low as long as the motor's rotor turns normally in response to each drive pulse. But if the rotor does not rotate in response to a drive pulse, the missed step is indicated with signal H going high briefly before the next drive pulse.

The signal H pulse that appears when the rotor has not rotated triggers off, in the circuit of Swiss Patent Specification No. 628 201, a corrective drive pulse destined to retrieve the missed step.

To improve the effectiveness of the corrective pulse and to prevent the time being displayed by the timepiece from going wrong, the pulse is made to last longer than the normal drive pulses that are produced to operate the motor with minimum energy consumption.

The circuit for retrieving missed steps can also be used in a timepiece according to this invention although it is not needed to produce the cell's end of life warning signal. It is to this end that control circuit 3 is provided with the input C that can be connected to the output S of circuit 7. Thus, in response to any pulse on signal $S_7$ circuit 3 will produce a corrective drive pulse on signal $S_3$.

The output S of detecting circuit 7 is connected to one input of AND gate 9 whose output is connected to the counting input C of counter 8 which, on its output Q, issues a logic missed-step detection signal $Q_8$. Counter 8 has a capacity N and it is being assumed that upon being energised the counter will be in state 0. Its output Q then remains low as long as it has counted less than N pulses; and goes high at the Nth pulse whereupon it goes low again at the next pulse. Output Q is connected to the input A of circuit 3 to cause irregular motion of seconds hand 5, indicative of the end of the cell's life. Output Q is also connected to the input of inverter 12 whose output is connected to the other input of AND gate 9 and to one input of AND gate 10. The output of AND gate 10 is connected to one input of OR gate 11 whose output is connected to the resetting input R of counter 8. The other input of AND gate 10 and the other input of OR gate 11 are respectively connected to the outputs B and C of divider 2.

The circuit shown in FIG. 1 operates as follows:

Upon the circuit being energized by a new cell, the output Q of counter 8 goes low. With the input A of control circuit 3 also being low, the output S of circuit 3 produces, in response to signals from oscillator 1 and frequency divider 2, a control signal $S_3$ causing seconds hand 5 to move forward regularly. The low logic state of output Q induces a high logic state at the outputs of AND gates 9 and 10 which are connected to the output of inverter 12. These two gates thus allow the signals that are present on their other inputs to go through.

As the cell becomes exhausted, its voltage drops and after reaching a certain critical threshold, motor 4 starts missing steps. At each missed step, the output S of detecting circuit 7 issues a pulse which travels through AND gate 9 to increment counter 8 by one unit. Also, the signal that is provided by divider 2 on its output B travels through AND gate 10 and OR gate 11 to reset counter 8 once a minute. Thus, if the number of steps missed by motor 4 per minute is less than N, counter 8 will never be full and its output Q, that which issues detection signal $Q_8$, will remain permanently low. But if the number of missed steps per minute reaches or exceeds N, the output Q of counter 8 and detection signal $Q_8$ go high at the Nth step. This causes the output of inverter 12 to go low, thereby blocking AND gates 9 and 10. Thus, the signal corresponding to the $(N+1)$th missed step will not reach counter 8, nor will the minute pulses that are issued on the output B of divider 2. The output Q of counter 8 therefore remains permanently high, causing the warning signal by hand 5 to occur.

Of course, if the missed steps are retrieved the timepiece carries on showing the right time, without affecting the operation of the above described circuit.

N is an arbitrary number and it sets the limit between the number of missed steps per unit of time that is acceptable due to transient causes such as shocks or the influence of a strong magnetic field, and the number of missed steps that is indicative of impending permanent breakdown of the timepiece due essentially to exhaustion of the cell.

Whatever value is chosen for N, there will always be situations in which the warning signal erroneously indicates the imminent end of the cell's life, such as when the timepiece is subjected to a magnetic field that causes the motor to stop for a sufficiently long time. Once removed from the field's influence the timepiece will of course resume normal operation.

To avoid such erroneous information, counter 8 is periodically reset, e.g. once an hour, by the signal that is on the output C of frequency divider 2 and that is conveyed to the input R of counter 8 via OR gate 11. The warning signal then only indicates cell exhaustion if it lasts for at least one hour.

Figure 2:
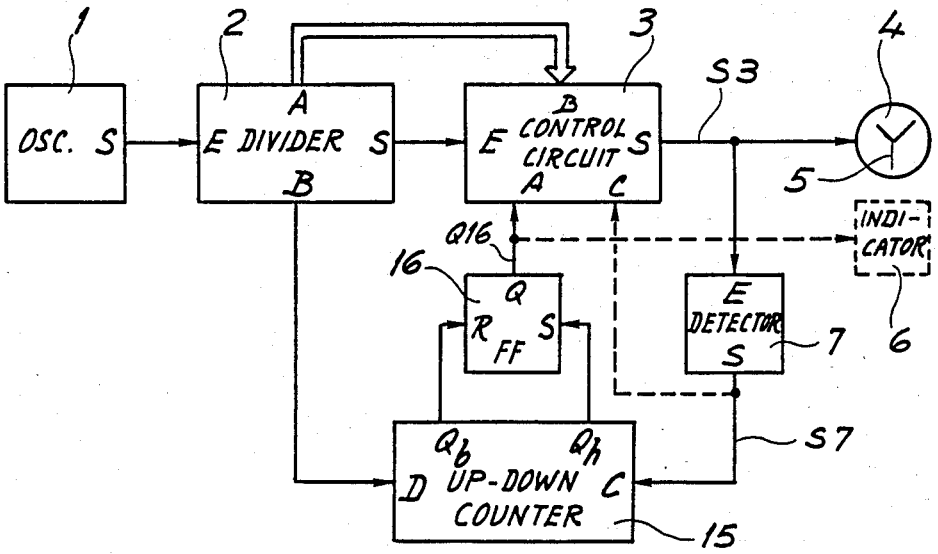
FIG. 2 is a diagram of a second form of embodiment of a circuit for a timepiece according to the invention.

In the circuit shown in FIG. 2, elements 1 to 7 are similar to those of the circuit shown in FIG. 1 and are arranged in the same way.

The FIG. 2 circuit further comprises an up-down counter 15 having two inputs C and D and two outputs $Q_h$ and $Q_b$. Counter 15 can count up to N+1. It can thus be in N+1 different states, i.e. 0, 1, 2, . . . , N−1 or N. Its input C enables forward counting, i.e. the incrementation of counter 15, and its input enables backward counting, i.e. counter decrementation. The output $Q_h$ of counter 15 is an overflow output. It issues a signal when counter 15 goes from state N−1 to state N in response to a pulse applied to input C. Output $Q_b$, on the other hand, is an underflow output. It issues a pulse when counter 15 goes from state 1 to state 0 in response to a pulse applied to input D. But when counter 15 goes from state N to state 0 or from state 0 to state N, no signal is issued by outputs $Q_h$ and $Q_b$. The input C of counter 15 is connected to the output S of circuit 7 for detecting missed steps, while its input D is connected to the output B of frequency divider 2. The counter's output $Q_h$ is connected to the set input S of an SR flip-flop 16, while its output $Q_b$ is connected to the reset input R of flip-flop 16. The output, Q, of flip-flop 16 is connected to the input A of control circuit 3. A high level signal when applied to the input S of flip-flop 16 will cause the latter's output Q to go high but when applied to the flip-flop's input R will cause output Q to go low. A low level signal, on the other hand, will have no effect on the inputs of flip-flop 16.

The circuit shown in FIG. 2 operates as follows:

If the cell supplying the timepiece still has a good charge, the number of missed steps will be low e.g. less than, on average, one step per minute. Counter 15 will then receive on its input C, on balance, a lesser number of pulses than on its input D which, by being connected to the output B of frequency divider 2, receives one pulse per minute. Counter 15 will therefore, on balance, be decremented and, upon passing from state 1 to state 0, the pulse generated by output $Q_b$ will reset flip-flop 16 or will maintain this state. The output Q of flip-flop 16, and hence detection signal $Q_{16}$, being then in a low logic state, the timepiece will produce no end of life warning signal regarding the cell.

But if the cell nears exhaustion, the number of missed steps will be high, e.g. greater, on average, than one missed step per minute. Counter 15 will then, on balance, be incremented and, when passing from state N−1 to state N, the pulse generated by output $Q_h$ will cause the output Q of flip-flop 16 to go high, causing detection signal $Q_{16}$ to go high also. This high level of signal $Q_{16}$ will induce the signal warning of the cell's imminent end of life, as in the FIG. 1 arrangement.

Of course, the frequency of the pulses applied to the input D of counter 15 may be other than that indicated by way of example and, if each missed step is retrieved, this correction will in no way affect the operation of the circuit.

By way of modification, the timepiece may comprise, instead of or besides hands for displaying the time, electro-optic display means including a visual indicator for signalling the cell's end of life, involving for instance liquid crystals or light emitting diodes, referenced 6 in FIGS. 1 and 2. The control input of such display means is connected to the output Q of counter 8 or to the output Q of flip-flop 16. When these outputs issue a signal $Q_8$ or $Q_{16}$ of high logic level, the visual indicator is activated and issues a warning signal equivalent to that produced earlier by irregular motion of seconds hands 5.

The invention is also applicable to timepieces issuing a control circuit that permanently adjusts, by discrete steps, the duration of drive pulses, between a maximum value and a minimum value, to the motor's momentary load to avoid unnecessarily high energy consumption by the motor. This duration is so chosen that the number of missed steps per unit of time remains below a set limit, each missed step being in any event also retrieved to avoid the time displayed from going wrong. A timepiece having such an arrangement is described in detail in, for instance, U.S. Pat. No. 4,326,278. The signal warning of the cell's imminent end of life can then only be issued, as described above, when the duration of the drive pulses has reached its maximum value for a set length of time.

The timepieces that have been described and illustrated may be modified in various other ways within the scope of the claims.

I claim:

1. An electronic timepiece comprising means for producing drive pulses, a motor having a rotor and means for turning the rotor through a set angle in response to each drive pulse, an autonomous source for supplying the drive pulse producing means with electric energy, means for producing an imminent end-of-life signal upon detecting the imminent end of the source's life and means for producing a warning signal in response to the signal from the detecting means, wherein the detecting means include means for producing a tally signal whenever the rotor does not turn correctly in response to a drive pulse, and a counter arranged to be incremented directly by said tally signal, with said counter producing, in response to a predetermined state, the imminent end-of-life signal.

2. An electronic timepiece as in claim 1, wherein the detecting means include means for periodically resetting said counter to zero.

3. An electronic timepiece as in claim 1, wherein said counter is an up-down counter which is incremented by the tally signals and decremented by periodic signals.

4. An electronic timepiece as in claim 1, wherein the drive pulse producing means include means enabling the rhythm of the drive pulses to be modified in response to said imminent end-of-life signal.

5. An electronic timepiece as in claim 1, further comprising electro-optic display means that change the appearance of their display in response to said imminent end-of-life signal.

* * * * *